US008579047B2

(12) United States Patent
Houston

(10) Patent No.: US 8,579,047 B2
(45) Date of Patent: Nov. 12, 2013

(54) DOWNHOLE RESERVOIR EFFLUENT COLUMN PRESSURE RESTRAINING APPARATUS AND METHODS

(76) Inventor: Norman DeVerne Houston, Neosho, MO (US)

( * ) Notice: Subject to any disclaimer, the term of this patent is extended or adjusted under 35 U.S.C. 154(b) by 130 days.

(21) Appl. No.: 12/460,071

(22) Filed: Jul. 13, 2009

(65) Prior Publication Data

US 2010/0006340 A1 Jan. 14, 2010

Related U.S. Application Data

(60) Provisional application No. 61/134,592, filed on Jul. 11, 2008.

(51) Int. Cl.
*E21B 17/00* (2006.01)
*E21B 10/22* (2006.01)

(52) U.S. Cl.
USPC ..... 175/243; 175/325.3

(58) Field of Classification Search
USPC ..... 175/230, 65, 57, 171, 238, 243, 325.3; 166/241.3, 195
See application file for complete search history.

(56) References Cited

U.S. PATENT DOCUMENTS

| | | | | | |
|---|---|---|---|---|---|
| 1,697,249 | A * | 1/1929 | Macready | 166/264 |
| 2,589,430 | A * | 3/1952 | Pletcher | 166/123 |
| 3,280,925 | A * | 10/1966 | Becker et al. | 175/58 |
| 3,503,461 | A * | 3/1970 | Shirley | 175/230 |
| 3,746,097 | A * | 7/1973 | Mott | 166/374 |
| 4,102,418 | A * | 7/1978 | Kammerer, Jr. | 175/324 |
| 4,534,715 | A * | 8/1985 | Jones | 417/456 |
| 6,412,574 | B1 * | 7/2002 | Wardley et al. | 175/7 |
| 7,086,481 | B2 * | 8/2006 | Hosie et al. | 166/387 |
| 7,775,299 | B2 * | 8/2010 | Khan et al. | 175/57 |
| 2004/0055758 | A1 * | 3/2004 | Brezinski et al. | 166/384 |
| 2004/0144566 | A1 * | 7/2004 | Fisher | 175/55 |
| 2005/0028973 | A1 * | 2/2005 | Paluch et al. | 166/264 |
| 2006/0157282 | A1 * | 7/2006 | Tilton et al. | 175/65 |
| 2008/0264690 | A1 * | 10/2008 | Khan et al. | 175/25 |

* cited by examiner

*Primary Examiner* — Jennifer H Gay
*Assistant Examiner* — Catherine Loikith
(74) *Attorney, Agent, or Firm* — Bruce E. Houston

(57) ABSTRACT

Apparatus and methods operate to seal off a column of effluents standing in a borehole annulus from a drill bit assembly during earth drilling operations. A seal assembly, sections of drill pipe, and tubular casing members are assembled into a fluid pressure-restraining drilling tool. The drilling tool is inserted into a drill string above the drill bit. The seal assembly tracks with the drill string, traveling along the borehole wall to maintain an annular seal at a substantially constant position above the drill bit as drilling operations progress. Pressures produced by the column of effluents are exerted at the upper portion of the seal as the effluent column is prevented from reaching the drill bit.

22 Claims, 5 Drawing Sheets

DOWNHOLE RESERVOIR EFFLUENT COLUMN PRESSURE RESTRAINING APPARATUS AND METHODS

PRIORITY TO EARLIER-FILED APPLICATION

This Regular Application is filed under 35 U.S.C. §111(a) and claims priority under 35 U.S.C. §119(e)(1) to Provisional Application No. 61/134,592, filed on Jul. 11, 2008.

TECHNICAL FIELD

Various embodiments described herein relate to well drilling apparatus and methods, including apparatus and methods to reduce downhole pressure resulting from a column of reservoir effluents.

BACKGROUND INFORMATION

Modern well-drilling operations commonly use a drill bit, drill pipe (sometimes referred to as "the drill string") connected to the drill bit, and rotational machinery at the surface to rotate the drill pipe, resulting in rotation of the drill bit. The drill string is extended in length by adding additional sections of drill pipe as the drilling creates an ever deeper borehole.

Materials dislodged from the bottom of the borehole by the drill bit are flushed to the surface, typically using compressed air and a liquid carrier transferred down the center of the hollow drill pipe. Water, drilling mud, and other suitable substances may be used as the liquid carrier. The carrier and compressed air are forced down the center of the drill pipe under pressure from compressors at the surface. The liquid carrier washes the cuttings away from the drill; and the liquid carrier and the cuttings are forced to the surface by the compressed air through an annulus that is typically the annulus between the outer surface of the drill pipe and the borehole wall.

As well drilling operations proceed down the borehole, reservoirs of liquids and/or gases ("effluents") may be encountered at various levels above the final borehole depth. The effluents tend to pour to the bottom of the borehole and accumulate in the annulus between the drill string and the borehole wall, forming an approximately annular column of effluents. The column of effluents exerts both downward and lateral pressure on the drill bit assembly. Compressor and/or booster equipment at the surface must produce sufficient pressure to overcome the pressure exerted by the column of effluents as well as pressure sufficient to force the liquid carrier down the drill pipe and to force the liquid carrier and cuttings up the borehole annulus to the surface. Increasingly greater pressures must be generated at the surface to overcome the increasingly taller column of effluents as the borehole depth increases.

An additional and related problem occurs with a commonly-used "downhole hammer" type of drill bit assembly. The downhole hammer uses a pneumatic cylinder mechanism driven by the compressed air being forced down the hollow drill pipe. The downhole hammer exerts periodic bursts of additional torque and/or downward force at the drill bit to aid in drilling. Pressure from the water column impedes operation of the pneumatic cylinder, adding yet more load on the compressor/booster equipment at the surface.

The additional torque and pneumatic pressure supply are produced by larger diesel engines and a correspondingly greater consumption of diesel fuel at the surface. This ratcheting-up of torque and pneumatic pressure necessary to drill deeper may continue until a drilling rig including compressors/boosters of a particular size and power and a drill string of a particular strength are no longer capable of rotating the drill bit assembly, operating the pneumatic mechanism associated with the downhole hammer, and expelling the effluents, liquid carrier, and cuttings to the surface. This state is referred to in the water well-drilling industry as "watering out," and indicates the maximum drilling depth possible for the drilling rig.

The phenomenon of the forces caused by upper-reservoir effluents impeding the drilling process results in the waste of precious oil and water resources. The combustion of the extra diesel fuel required to overcome these forces releases large amounts of greenhouse gases and results in a concomitant environmental impact. Millions of gallons of water are wasted as the compressed air forces water flowing from the reservoirs/aquifers to the surface and out onto the ground.

DETAILED DESCRIPTION

Figure 1:
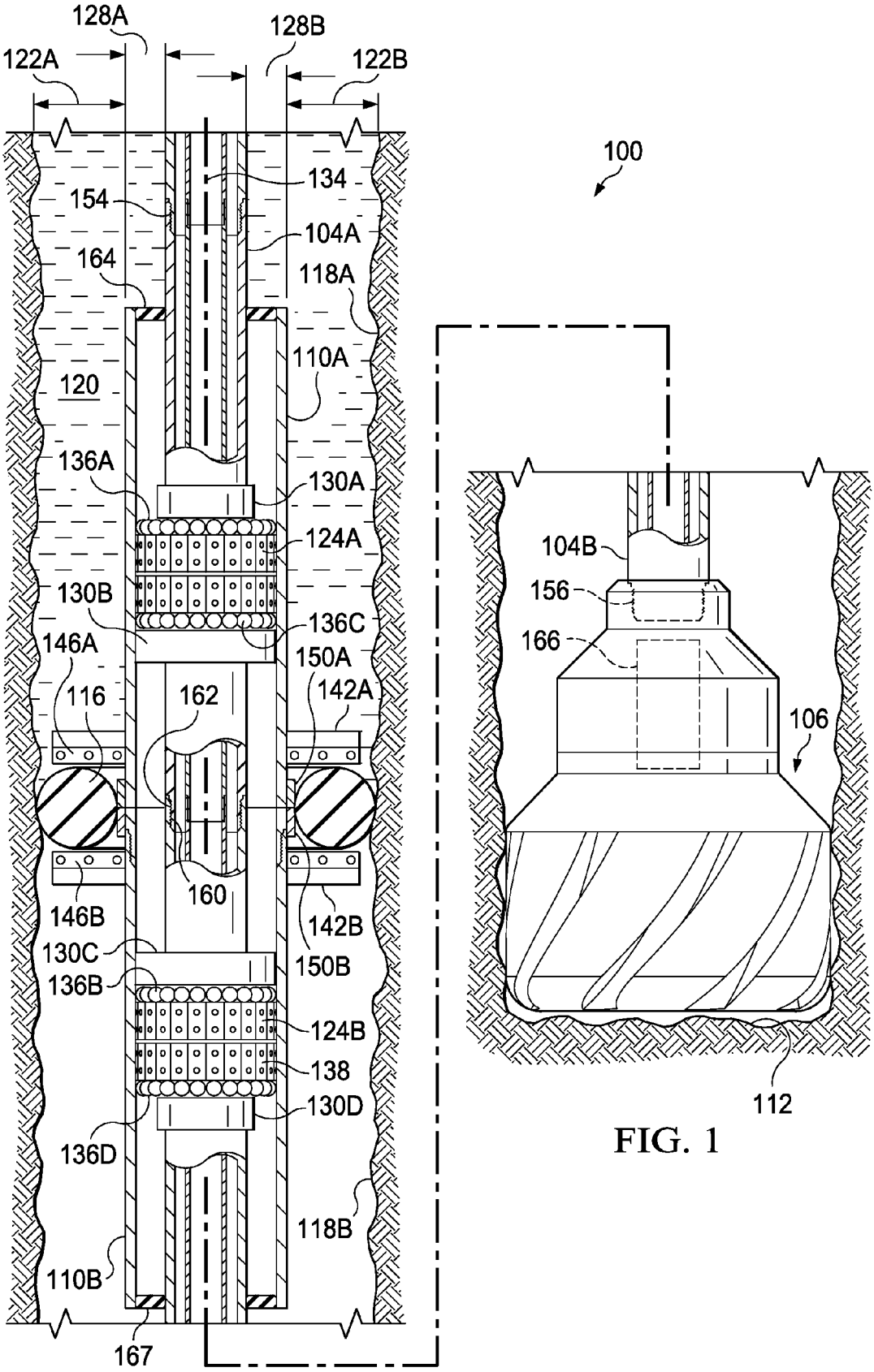
FIG. 1 is a diagram of a downhole effluent column pressure restraining apparatus according to various example embodiments of the current invention.

FIG. 1 is a diagram of a downhole effluent column pressure restraining apparatus 100 according to various example embodiments of the invention. Embodiments described herein and the various equivalents that may derive therefrom operate to form a barrier between a column of reservoir effluent standing in a borehole annulus and a well-drilling bit assembly at a substantially constant point above the bit assembly. Doing so substantially isolates pressures exerted by the column of effluents and prevents effluent pressures from exerting against a pressurized flow of drilling fluids at the drill bit assembly. Increased borehole penetration, decreased fuel consumption, decreased amounts of waste effluent, and a decreased negative environmental impact may result.

It is noted that although example embodiments herein may be described in the context of water wells, the subject matter of this disclosure applies generally to any type of effluent-producing well drilled into the earth having a vertical component, whether water, gas, petroleum, or other effluent.

The apparatus 100 operates in conjunction with reverse circulation drilling techniques. The drill string comprises a multi-walled drill pipe (e.g., a double-walled drill pipe described in embodiments below). The multi-walled drill pipe delivers drilling liquid and compressed air from the surface to the drill bit assembly through one conduit of the multi-walled drill pipe. The compressed air, drilling liquid, and cuttings are returned to the surface through another conduit of the multi-walled drill pipe. The apparatus 100 includes a section of drill string 104A, 104B proximate to a well-drilling bit assembly 106.

The apparatus 100 also includes a tubular casing member 110A, 110B to surround the section of drill string 104A, 104B and to track with the section of drill string 104A, 104B down a borehole 112 as drilling progresses. "To track" in the context of the embodiments described herein means to move in substantial synchronism with. The section of drill string

104A, 104B and the tubular casing member 110A, 110B are each depicted as two-piece assemblies in FIG. 1. However, it is noted that each of these two elements may be a single structure or any other number of structures in the various embodiments contemplated herein.

In a two-piece embodiment, the section of drill string includes the two sub-sections of drill string 104A and 104B. Each of the two sub-sections of drill string 104A and 104B is threaded at both ends. The upper threaded end 154 of the top sub-section of drill string 104A is provided to couple the section of drill string 104A, 104B to additional drill string extending to the surface. The lower threaded end 156 of the bottom sub-section of drill string 104B is provided to couple the section of drill string 104A, 104B to the well-drilling drill bit assembly 106 or to an additional section of drill string coupled between the section of drill string 104A, 104B and the bit assembly 106.

A lower threaded end 160 of the top sub-section of drill string 104A and an upper threaded end 162 of the bottom sub-section of drill string 104B are provided to decouple the two sub-sections of drill string. Decoupling the two sub-sections of drill string facilitates replacing components of the apparatus 100, including one or more seal assemblies 116 and/or one or more inner annular bearing assemblies 124A, 124B. The lower end of the top section 110A of the tubular casing member and the upper end of the bottom section 110B of the tubular casing member may be threaded for assembly/disassembly in like fashion.

The seal assembly 116 extends radially from the tubular casing member 110A, 110B for 360 degrees around the tubular casing member 110A, 110B to contact the borehole wall 118A, 118B during drilling operations. The seal assembly 116 thus forms a barrier between a column of reservoir effluent 120 standing in the borehole annulus 122A, 122B and the well-drilling bit assembly 106. In some embodiments, the seal assembly 116 tracks with the tubular casing member 110A, 110B down the borehole 112 as drilling progresses.

In some embodiments, the seal assembly 116 is in rotational contact with the borehole wall 118A, 118B as the drill string 104A, 104B, the tubular casing member 110A, 110B, and the seal assembly 116 travel up or down the borehole together. In such case, one or more elements of the seal assembly 116 may rotate at the borehole wall 118A, 118B while other elements of the seal assembly 116 remain stationary at the tubular casing member 110A, 110B. In some embodiments, the seal assembly 116 may rotate at both the borehole wall 118A, 118B and at the tubular casing member 110A, 110B. In some embodiments, the entire seal assembly 116 may rotate in order to maintain rotational contact with the borehole wall 118A, 118B.

In some embodiments, the seal assembly 116 may rotate about its own annular axis. In the latter case, the seal assembly 116 may be formed in the shape of a toroid and may comprise a flexible, compressible material in whole or in part. Constructed according to one or more of these embodiments, the seal assembly 116 is capable of forming a seal between the borehole wall 118A, 118B and the tubular casing member 110A, 110B that moves as drilling progresses. The seal assembly 116 supports the pressure exerted by the column of effluents 120 at a point above the well-drilling bit assembly 106 and substantially isolates the column pressure from the downhole hammer 166 and from the pressurized flow of drilling fluid down the drill string and/or drilling fluid plus cuttings up one or more channels of the drill string.

The apparatus 100 may also include one or more inner annular bearing assemblies 124A, 124B, as previously mentioned. The inner annular bearing assemblies 124A, 124B are positioned about the section of drill string 104A, 104B to operate in an intermediate annulus 128A, 128B between the tubular casing member 118A, 118B and the section of drill string 104A, 104B. The inner annular bearing assemblies 124A, 124B may be affixed to the section of drill string 104A, 104B or may rotate freely about the section of drill string 104A, 104B. The inner annular bearing assemblies 124A, 124B prevent contact between an inner surface of the tubular casing member 118A, 118B and an outer surface of the section of drill string 104A, 104B. The inner annular bearing assemblies 124A, 124B also reducing friction between the inner surface of the tubular casing member 118A, 118B and the outer surface of the section of drill string 104A, 104B as the section of drill string 104A, 104B rotates during drilling operations.

The apparatus 100 may further include two or more inner annular bearing keeper collars 130A, 130B, 130C, 130D. At least one of the keeper collars is affixed above the inner annular bearing assemblies 124A, 124B and at least one of the keeper collars is affixed below the inner annular bearing assemblies 124A, 124B. Each annular bearing keeper collar 130A, 130B, 130C, 130D is affixed to the inner surface of the tubular casing member 110A, 110B or to the outer surface of the section of drill string 104A, 104B. The keeper collars 130A, 130B, 130C, 130D support the inner annular bearing assemblies 124A, 124B and inhibit relative movement between the tubular casing member 110A, 110B and the section of drill string 104A, 104B along a longitudinal axis 134 of the section of drill string 104A, 104B.

In some embodiments, the inner annular bearing assemblies 124A, 124B may comprise a set of roller bearings or a set of ball bearings in contact with both the inner surface of the tubular casing member 110A, 110B and the outer surface of the section of drill string 104A, 104B. In such case, the inner annular bearing assemblies 124A, 124B may rotate freely about the section of drill string 104A, 104B. In some embodiments, the bearing race may be seated on the section of drill string 104A, 104B. In that case, the roller bearings or ball bearings may contact only the inner surface of the tubular casing member 110A, 110B.

In some embodiments, the inner annular bearing assemblies 124A, 124B may include additional sets of bearings (e.g., roller bearings or ball bearings) 136A, 136B, 136C, and 136D. Additional sets of bearings (e.g., the sets of bearings 136A, 136B) may be located at the top of the inner annular bearing assemblies 124A, 124B. Additional sets of bearings (e.g., the sets of bearings 136C, 136D) may also be located at the bottom of the inner annular bearing assemblies 124A, 124B. The additional sets of bearings 136A, 136B, 136C, 136D contact each of the two bearing keeper collars (e.g., the bearing keeper collars 130C and 130D) adjacent an inner annular bearing assembly (e.g., the inner annular bearing assembly 124B). Alternatively, the additional sets of bearings may contact a bearing keeper collar (e.g., the bearing keeper collar 130C) and an additional inner annular bearing assembly (e.g., the additional inner annular bearing assembly 138). The additional sets of bearings 136A, 136B, 136C, 136D reduce friction between a bearing race associated with an inner annular bearing assembly and the corresponding bearing keeper collars (e.g., the inner annular bearing assembly 124B and the corresponding bearing keeper collars 130C, 130D) in the case of a freely rotating inner annular bearing assembly.

The apparatus 100 may also include two or more seal assembly keeper collars 142A, 142B. The seal assembly keeper collars 142A, 142B may be affixed about the tubular casing member 110A, 110B. One of the seal assembly keeper collars 142A, 142B may be affixed below the seal assembly 116 and one of the seal assembly keeper collars may be affixed above the seal assembly 116. The seal assembly keeper collars 142A, 142B inhibit relative movement between the seal assembly 116 and the tubular casing member 110A, 110B along a longitudinal axis of the tubular casing member (e.g., substantially the same axis as the axis 134 of the section of drill string 104A, 104B).

In some embodiments, the apparatus 100 may further include two or more outer annular bearing assemblies 146A, 146B. The outer annular bearing assemblies 146A, 146B may be seated on the tubular casing member 110A, 110B. Each of the outer annular bearing assemblies 146A, 146B is positioned between one of the seal assembly support collars 142A, 142B and the seal assembly 116. The outer annular bearing assemblies 146A, 146B operate to reduce friction between each of the seal assembly support collars 142A, 142B and the seal assembly 116 as the seal assembly 116 or a portion thereof rotates along the borehole wall 118A, 118B.

The apparatus 100 may also include a seal-tracking bearing assembly 150A, 150B. The seal-tracking bearing assembly 150A, 150B may be seated on the tubular casing member 110A, 110B between the seal assembly keeper collars 142A, 142B. The seal-tracking bearing assembly 150A, 150B may reduce friction between an inner circumferential surface of the seal assembly 116 and the tubular casing member 110A, 110B as the seal assembly 116 or a portion thereof rotates along the borehole wall 118A, 118B. In some embodiments, the seal-tracking bearing assembly 150A, 150B may be recessed into the surface of the tubular casing member 110A, 110B.

The apparatus 100 may further include a top-end seal 164 at the upper end of the top sub-section 110A of the tubular casing member 110A, 110B. The top-end seal 164 extends radially between the outer surface of the section of drill string 104A, 104B and the inner surface of the tubular casing member 110A, 110B. A bottom-end seal 167 at the lower end of the bottom sub-section 110B of the tubular casing member 110A, 110B extends radially between the outer surface of the section of drill string 104A, 104B and the inner surface of the tubular casing member 110A, 110B.

Seal Assembly Detail

In review, the downhole well-drilling seal assembly 116 of FIG. 1 comprises an annular element to extend radially from the tubular casing member 110A, 110B for 360 degrees around the tubular casing member 110A, 110B. The seal assembly 116 extends to the wall of the well borehole 118A, 118B and contacts the wall of the well borehole 118A, 118B, forming a seal at the wall of the well borehole 118A, 118B. The seal assembly 116 thus inhibits the passage of the reservoir effluents 120 from above. The seal assembly 116 tracks with the tubular casing member 110A, 110B as the tubular casing member 110A, 110B, the seal assembly 116, and the section of drill string 104A, 104B move together along the longitudinal axis 134 of the borehole 112 during drilling operations.

The seal assembly 116 may be formed as various shapes. For example, the seal assembly 116 may be formed as a substantially planar shape, an annular columnar shape, or a toroidal shape, among others. In some embodiments, the seal assembly 116 may be in rotational contact with the borehole wall 118A, 118B. In some embodiments, the seal assembly 116 may scrape the borehole wall as the seal assembly 116 and the tubular casing member 110A, 110B descend down the borehole 112 together as drilling operations progress.

Figure 2A:
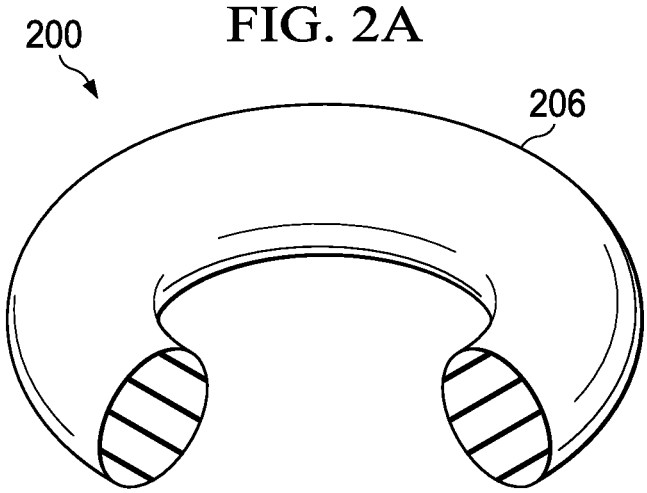
FIGS. 2A and 2B are diagrams of a toroidal seal assembly according to various example embodiments.
Figure 2B:
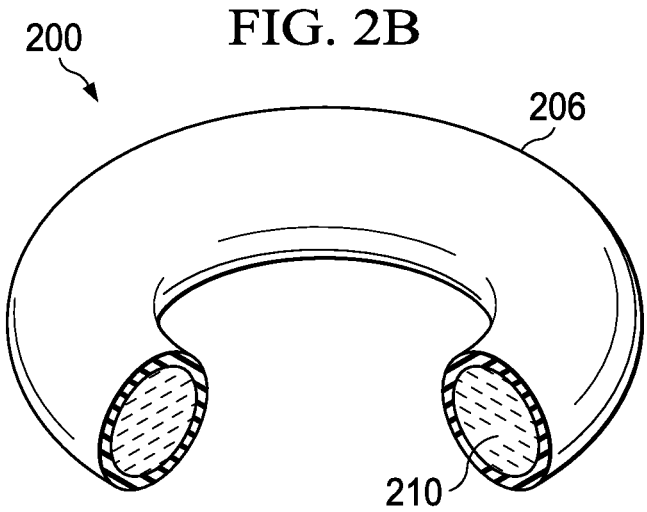

FIGS. 2A and 2B are diagrams of a toroidal seal assembly 200 according to various example embodiments. Referring to FIGS. 2A and 2B in view of FIG. 1, the toroidal seal assembly 200 may comprise a solid toroid 206 of a flexible, compressible material. In some embodiments, a hollow space within the toroidal seal assembly 200 may be filled with a compressed gas or other fluid 210, as illustrated in FIG. 2B. The toroidal seal assembly 200 may be mounted on and affixed to the tubular casing member 118A, 118B and may slip or scrape against the borehole wall 118A, 118B as the toroidal seal assembly 200 and the tubular casing member 110A, 110B move together within the borehole 112.

In some embodiments, the toroidal seal assembly 200 may be mounted on the tubular casing member 110A, 110B and may rotate about its own annular axis to maintain rotational contact with the borehole wall 118A, 118B as the toroidal seal assembly 200 and the tubular casing member 110A, 110B move together along the drill string axis 134 within the borehole 112. This latter mode of operation may result in a tighter seal at the borehole wall 118A, 118B and/or greater longevity for the toroidal seal assembly 200. The bearings 146A, 146B and/or 150A, 150B may be employed in some embodiments to reduce friction between the toroidal seal assembly 200 and the tubular casing member 110A, 110B as the toroidal seal assembly 200 rotates relative to the tubular casing member 110A, 110B while moving with the tubular casing member 110A, 110B along the drill string axis 134.

Figure 3A:
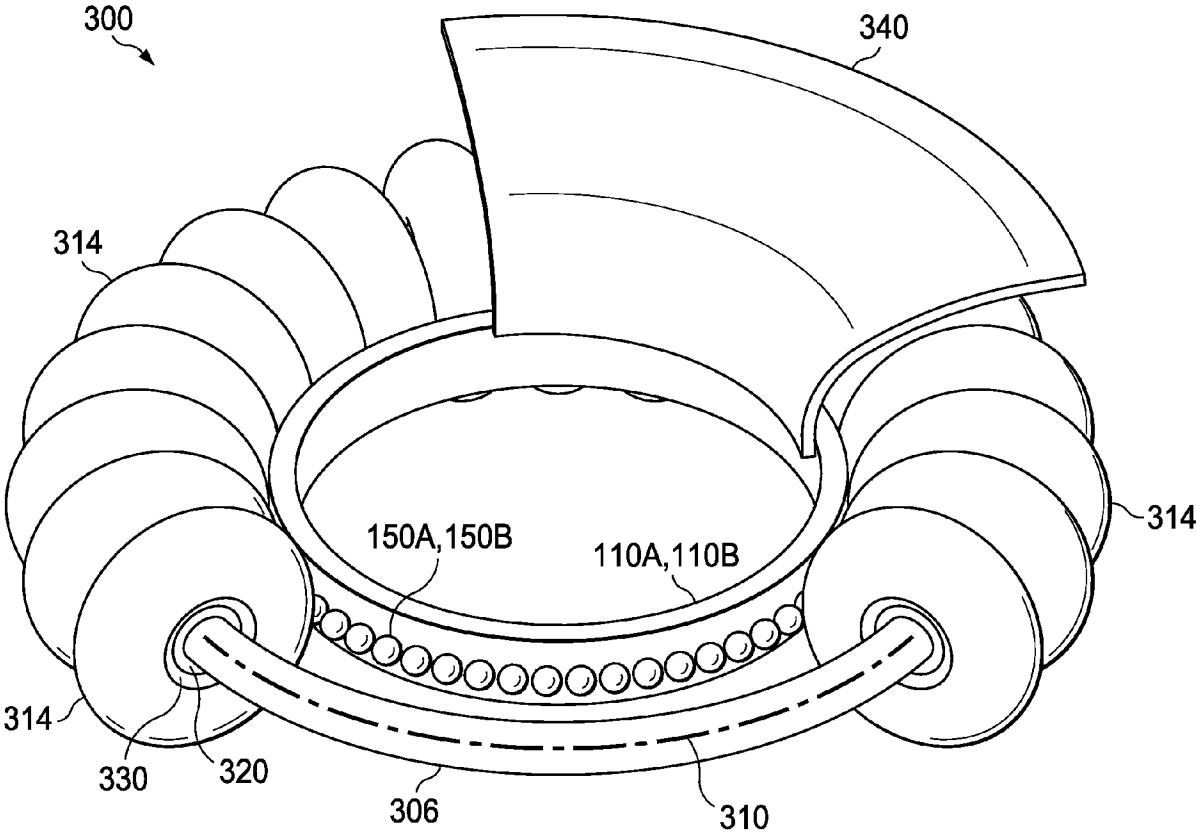
FIGS. 3A and 3B are diagrams of a multi-element toroidal seal assembly according to various example embodiments.
Figure 3B:
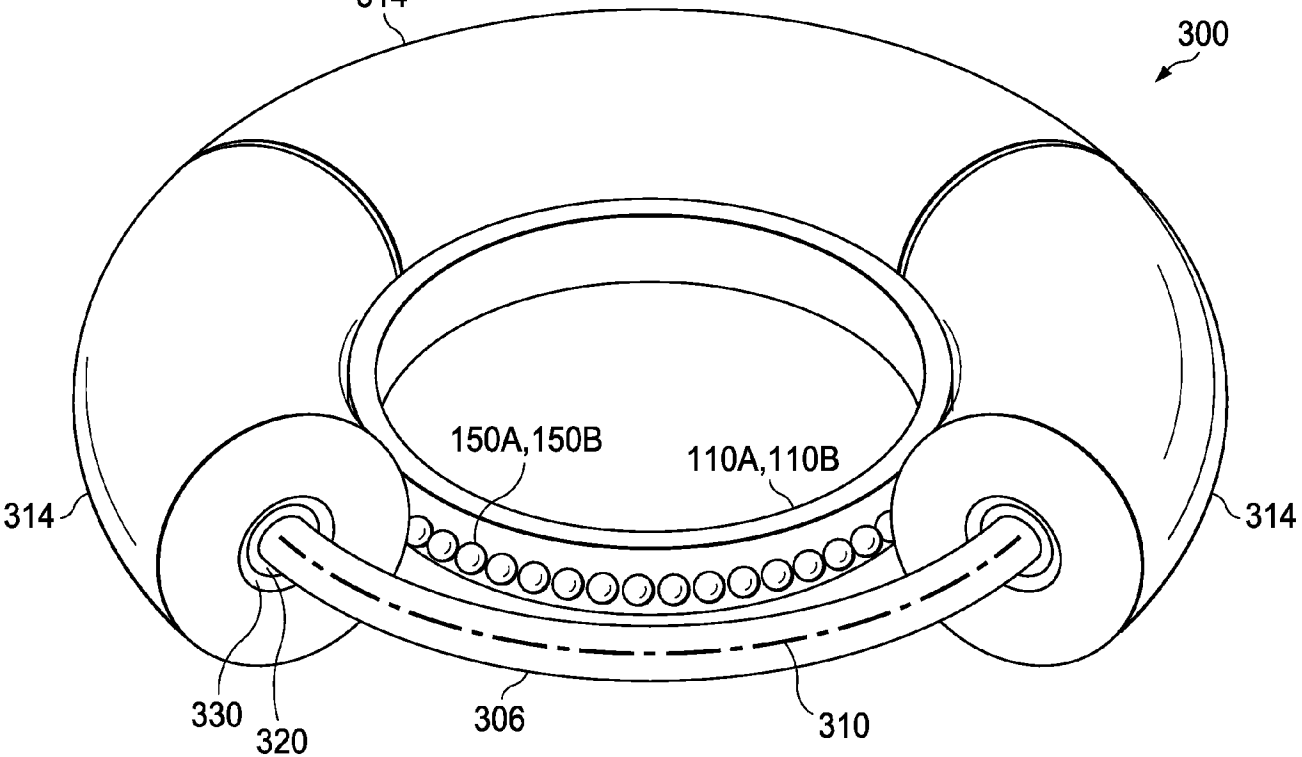

FIGS. 3A and 3B are diagrams of a multi-element toroidal seal assembly 300 according to various example embodiments. The multi-element toroidal seal assembly 300 may include a substantially rigid annular member 306 including an annular axis 310. The toroidal seal assembly 300 may also include one or more flexible annular sub-elements 314. (Example number only of annular sub-elements 314 is shown in FIGS. 3A and 3B for clarity.) The annular sub-elements 314 may be positioned about the substantially rigid annular member 306 along the annular axis 310 of the substantially rigid annular member 306. The flexible annular sub-element(s) 314 may rotate about the annular axis 310 of the substantially rigid annular member 306 while remaining in substantial rotational contact with the borehole wall 118A, 118B of FIG. 1.

The annular sub-elements 314 may be provided in various shapes according to the design goals of one skilled in the art. Sub-element 314 shapes may include a disk shape, a spherical shape, and/or a toroidal shape, among others.

In some embodiments, the annular sub-elements 314 may include a bearing member 320 positioned at a hub 330 of the annular sub-elements 314. The bearing member 320 reduces friction between the flexible annular sub-elements 314 and the substantially rigid annular member 306 as the flexible annular sub-elements 314 rotate about the annular axis 310 of the substantially rigid annular member 306.

The toroidal seal assembly 300 and/or other embodiments of the seal assembly 116 of FIG. 1 may include one or more flexible annular seal flap members 340. (Example section only of the flexible annular seal flap member 340 is illustrated in FIG. 3 for clarity.) The flexible annular seal flap members 340 may be affixed to the seal assembly 116 or to the tubular casing member 110A, 110B. The flap members 340 may extend to the surface of the borehole wall 118A, 118B and/or to the outer surface of the tubular casing member 110A, 110B to further seal off the column of reservoir effluent from the well-drilling bit assembly.

The toroidal seal assembly 300 may also include one or more seal tracking assembly bearings 150A, 150B at the tubular casing member 110A, 110B. The seal tracking assembly bearings 150A, 150B reduce friction between the inner circumference of the toroidal seal assembly 300 and the tubular casing member 110A, 110B as the toroidal seal assembly 300 rotates along the borehole wall 118A, 118B.

The apparatus and systems of various embodiments may be useful in applications other than forming a barrier between a column of reservoir effluent standing in a borehole annulus and a well-drilling bit assembly at a substantially constant point above the bit assembly during drilling operations. Thus, various embodiments of the invention are not to be so limited. The illustrations of the apparatus 100 and the toroidal seals 200 and 300 are intended to provide a general understanding of the structure of various embodiments. They are not intended to serve as a complete description of all the elements and features of apparatus and systems that might make use of the structures described herein.

The novel apparatus of various embodiments may comprise or be incorporated into various systems and methods of well-drilling, including water, oil, and natural gas wells and wells yielding other gases and fluids.

Figure 4:
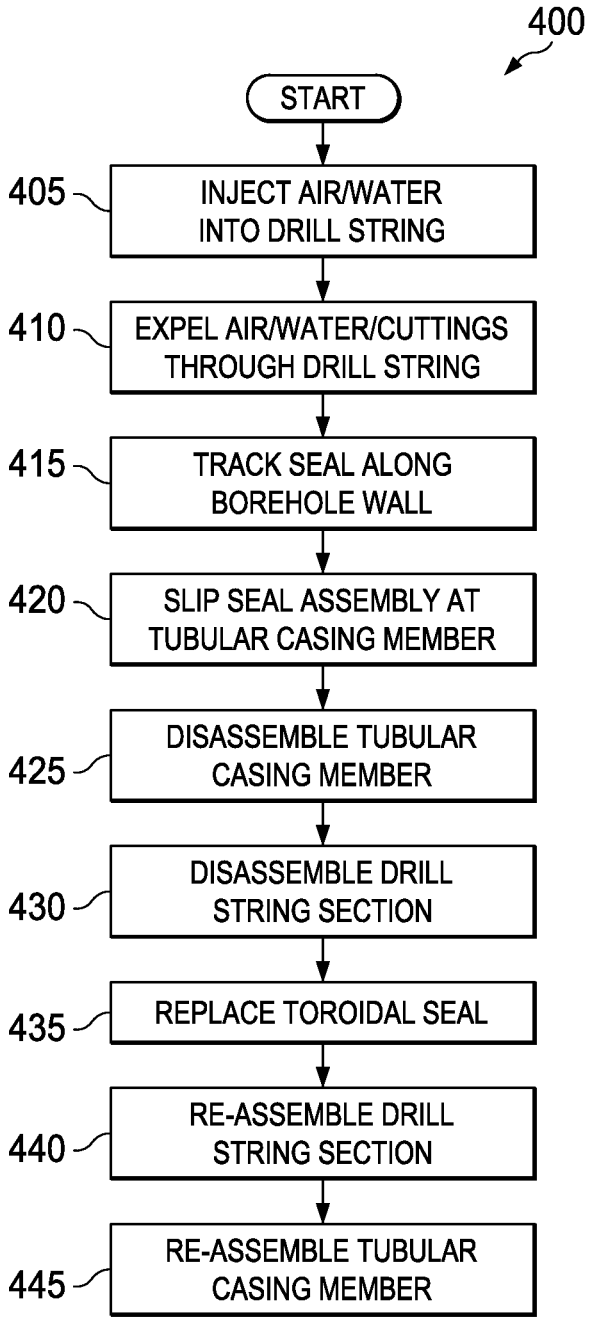
FIG. 4 is a flow diagram illustrating a method according to various example embodiments.

FIG. 4 is a flow diagram illustrating a method 400 according to various example embodiments. The method 400 operates to a column of reservoir effluent standing in a borehole annulus from falling down to a well-drilling bit assembly during drilling operations. Practice of the method 400 may operate to avoid impediments to the drilling operations caused by pressures resulting from the column of reservoir effluent and may result in the conservation of energy and water resources expended during drilling.

The method 400 may commence at block 405 with injecting air, water, or both into a drill string comprising a multi-wall drill pipe. The air and/or water may be injected into an annulus or a center conduit of the drill string. The method 400 may continue at block 410 with expelling the air, the water, and/or drilling cuttings through the annulus or the center conduit of the drill string.

The method 400 may also include tracking a substantially toroidal seal assembly along a wall of a borehole as the drilling operations progress, at block 415. The toroidal seal assembly may extend radially and substantially orthogonally from a tubular casing member enclosing a section of the drill string proximate to the well-drilling bit assembly. The toroidal seal assembly may be in rotational contact with the borehole wall.

The method 400 may further include slipping the toroidal seal assembly at the tubular casing member using one or more bearings, at block 420. The bearings reduce friction between the toroidal seal assembly and the tubular casing member and inhibit relative axial movement between the toroidal seal assembly and the tubular casing member along an axis of the tubular casing member.

The method 400 may also include disassembling one or more subsections of a multi-subsection embodiment of the tubular casing member proximate to the well-drilling bit assembly, at block 425. The method 400 may further include disassembling one or more subsections of a multi-subsection embodiment of the section of the drill string proximate to the well-drilling bit assembly, at block 430.

The method 400 may also include replacing the toroidal seal assembly, at block 435. The method 400 may further include re-assembling one or more subsections of the multi-subsection embodiment of the tubular casing member, at block 440. The method 400 may terminate at block 445 with re-assembling the one or more subsections of the multi-subsection embodiment of the section of drill string.

It is noted that the activities described herein may be executed in an order other than the order described. The various activities described with respect to the methods identified herein may also be executed in repetitive, serial, and/or parallel fashion.

The apparatus and methods described herein operate to form a barrier between a column of reservoir effluent standing in a borehole annulus and a well-drilling bit assembly at a substantially constant point above the bit assembly. Doing so isolates pressure exerted by the column of effluents from the drill bit assembly, thus reducing downhole pressures exerted against the pressurized flow of drilling fluids. Increased borehole penetration, decreased fuel consumption, decreased amounts of waste effluent, and a decreased negative environmental impact may result.

By way of illustration and not of limitation, the accompanying figures show specific embodiments in which the subject matter may be practiced. The embodiments illustrated are described in sufficient detail to enable those skilled in the art to practice the teachings disclosed herein. Other embodiments may be used and derived therefrom, such that structural and logical substitutions and changes may be made without departing from the scope of this disclosure. This Detailed Description, therefore, is not to be taken in a limiting sense. The breadth of various embodiments is defined by the appended claims and the full range of equivalents to which such claims are entitled Such embodiments of the inventive subject matter may be referred to herein individually or collectively by the term "invention" merely for convenience and without intending to voluntarily limit this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments and other embodiments not specifically described herein will be apparent to those of skill in the art upon reviewing the above description.

The Abstract of the Disclosure is provided to comply with 37 C.F.R. §1.72(b) requiring an abstract that will allow the reader to quickly ascertain the nature of the technical disclosure. It is submitted with the understanding that it will not be used to interpret or limit the scope or meaning of the claims. In the preceding Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. A downhole fluid pressure restraining apparatus, comprising:

a section of drill string proximate to a well-drilling bit assembly;

a tubular casing member to rotatively couple to the section of drill string and to track with the section of drill string down a borehole during drilling operations;

at least one seal assembly to extend radially from the tubular casing member for 360 degrees around the tubular casing member to an uncased drilling formation wall associated with the borehole, the seal assembly to support a column of reservoir effluent standing in an annulus between a drill string extending upward from the downhole pressure restraining apparatus and the drilling formation wall, to isolate pressure associated with the column of effluent from a pressurized flow of drilling fluids and/or cuttings at the well-drilling bit assembly, and to engage in rolling motion with the formation wall along a longitude of the formation wall as the drilling operations progress;

at least one inner annular bearing assembly positioned about the section of drill string to operate in an intermediate annulus between the tubular casing member and the section of drill string and to perform at least one of preventing contact between an inner surface of the tubular casing member and an outer surface of the section of drill string or reducing friction between the inner surface of the tubular casing member and the outer surface of the section of drill string; and at least two annular bearing keeper collars, at least one annular bearing keeper collar affixed below the inner annular bearing assembly and at least one annular bearing keeper collar affixed above the inner annular bearing assembly, each annular bearing keeper collar affixed to at least one of the inner surface of the tubular casing member or the outer surface of the section of drill string to support the at least one inner annular bearing assembly and to inhibit relative movement between the tubular casing member and the section of drill string along a longitudinal axis of the section of drill string.

2. The downhole fluid pressure restraining apparatus of claim 1, the at least one seal assembly shaped substantially as a torus, an outer surface of the at least one seal assembly comprising a flexible, compressible material to form a seal between the formation wall and the tubular casing member.

3. The downhole fluid pressure restraining apparatus of claim 1, the inner annular bearing assembly comprising at least one of a set of roller bearings or a set of ball bearings to contact both the inner surface of the tubular casing member and the outer surface of the section of drill string.

4. The downhole fluid pressure restraining apparatus of claim 1, the inner annular bearing assembly comprising at least one of a set of roller bearings or a set of ball bearings to contact two of the bearing keeper collars or one of the bearing keeper collars and an additional inner annular bearing assembly.

5. The downhole fluid pressure restraining apparatus of claim 1, further comprising:

at least two seal assembly keeper collars affixed about the tubular casing member, one seal assembly keeper collar affixed below the seal assembly and one seal assembly keeper collar affixed above the seal assembly, the seal assembly keeper collars to inhibit relative movement between the seal assembly and the tubular casing member along a longitudinal axis of the tubular casing member.

6. The downhole fluid pressure restraining apparatus of claim 5, further comprising:

at least two outer annular bearing assemblies seated on the tubular casing member, each outer annular bearing assembly positioned between one of the seal assembly support collars and the seal assembly to reduce friction between each seal assembly support collar and the seal assembly when the seal assembly rotates along the formation wall.

7. The downhole fluid pressure restraining apparatus of claim 5, further comprising:

a seal-tracking bearing assembly seated on the tubular casing member between two of the seal assembly keeper collars to reduce friction between an inner circumference of the seal assembly and the tubular casing member when the seal assembly rotates along the formation wall.

8. The downhole fluid pressure restraining apparatus of claim 7, the seal-tracking bearing assembly recessed into the tubular casing member.

9. The downhole fluid pressure restraining apparatus of claim 1, the seal assembly comprising a solid torus of a compressible, elastic material.

10. A downhole fluid pressure restraining apparatus, comprising:

a section of drill string proximate to a well-drilling bit assembly;

a tubular casing member to rotatively couple to the section of drill string and to track with the section of drill string down a borehole during drilling operations;

at least one seal assembly to extend radially from the tubular casing member for 360 degrees around the tubular casing member to an uncased drilling formation wall associated with the borehole, the seal assembly to support a column of reservoir effluent standing in an annulus between a drill string extending upward from the downhole pressure restraining apparatus and the drilling formation wall, to isolate pressure associated with the column of effluent from a pressurized flow of drilling fluids and/or cuttings at the well-drilling bit assembly, and to engage in rolling motion with the formation wall along a longitude of the formation wall as the drilling operations progress;

a substantially rigid annular member forming an annular axis; and at least one flexible annular sub-element positioned about the substantially rigid annular member along the annular axis of the substantially rigid annular member, the at least one flexible annular sub-element to rotate about the annular axis of the substantially rigid annular member while engaging in rolling motion with the formation wall.

11. The downhole fluid pressure restraining apparatus of claim 10, the at least one flexible annular sub-element formed in a shape selected from a group consisting of a disk, a sphere, or a torus.

12. The downhole fluid pressure restraining apparatus of claim 10, further comprising:

a bearing member positioned at a hub of the at least one flexible annular sub-element to reduce friction between the at least one flexible annular sub-element and the substantially rigid annular member when the at least one flexible annular sub-element rotates about the annular axis of the substantially rigid annular member.

13. A downhole fluid pressure restraining apparatus, comprising:

a section of drill string proximate to a well-drilling bit assembly;

a tubular casing member to rotatively couple to the section of drill string and to track with the section of drill string down a borehole during drilling operations;

at least one seal assembly to extend radially from the tubular casing member for 360 degrees around the tubular casing member to an uncased drilling formation wall associated with the borehole, the seal assembly to support a column of reservoir effluent standing in an annulus between a drill string extending upward from the downhole pressure restraining apparatus and the drilling formation wall, to isolate pressure associated with the column of effluent from a pressurized flow of drilling fluids and/or cuttings at the well-drilling bit assembly, and to engage in rolling motion with the formation wall along a longitude of the formation wall as the drilling operations progress; and at least one flexible annular seal flap member affixed to at least one of the seal assembly or the tubular casing member and extending to at least one of the surface of the borehole wall or the outer surface of the tubular casing member to further seal off the column of reservoir effluent from the well-drilling bit assembly.

14. A downhole fluid pressure restraining apparatus, comprising:

a section of drill string proximate to a well-drilling bit assembly;

a tubular casing member to rotatively couple to the section of drill string and to track with the section of drill string down a borehole during drilling operations;

at least one seal assembly to extend radially from the tubular casing member for 360 degrees around the tubular casing member to an uncased drilling formation wall associated with the borehole, the seal assembly to support a column of reservoir effluent standing in an annulus between a drill string extending upward from the downhole pressure restraining apparatus and the drilling formation wall, to isolate pressure associated with the column of effluent from a pressurized flow of drilling fluids and/or cuttings at the well-drilling bit assembly, and to engage in rolling motion with the formation wall along a longitude of the formation wall as the drilling operations progress;

a top-end seal at an upper end of the tubular casing member extending radially between the outer surface of the section of drill string and the inner surface of the tubular casing member; and a bottom-end seal at a lower end of the tubular casing member extending radially between the outer surface of the section of drill string and the inner surface of the tubular casing member.

15. The downhole fluid pressure restraining apparatus of claim 14, the section of drill string and the tubular casing member each comprising two sub-sections, each sub-section threaded at both ends to provide for de-coupling the two sub-sections to facilitate replacement of at least one of the seal assembly, an inner annular bearing assembly, the drill bit assembly, or drill string extending upward from the pressure restraining apparatus.

16. The downhole fluid pressure restraining apparatus of claim 14, the section of drill string comprising a double-wall drill pipe.

17. A downhole well-drilling seal assembly, comprising:

an annular element to extend radially from a tubular casing member of a downhole fluid pressure restraining apparatus for 360 degrees around the tubular casing member to a wall of an uncased drilling formation wall to support a column of reservoir effluents standing in an annulus between a drill string extending upward from the downhole fluid pressure restraining apparatus and the formation wall and to isolate pressure associated with the column of effluent from a pressurized flow of drilling fluids and/or cuttings at an associated well-drilling bit assembly while drilling is in progress;

a substantially rigid annular member forming an annular axis; and at least one flexible annular sub-element positioned about the substantially rigid annular member along the annular axis of the substantially rigid annular member, the at least one flexible annular sub-element capable of rotating about the annular axis of the substantially rigid annular member while engaging in rolling motion with the formation wall.

18. The downhole well-drilling seal assembly of claim 17, at least one portion of the annular element to engage in rolling motion with the formation wall along a longitude of the formation wall.

19. The downhole well-drilling seal assembly of claim 18, further including:

a seal tracking bearing at the tubular casing member to reduce friction between the annular element and the tubular casing member when the annular element rotates at the tubular casing member and at the formation wall.

20. The downhole well-drilling seal assembly of claim 17, the annular element comprising a flexible, compressible material formed as at least one of a solid torus or a hollow torus filled with a compressible fluid.

21. The downhole well-drilling seal assembly of claim 17, the at least one flexible annular sub-element formed in a shape selected from a group consisting of a disk, a sphere, or a torus.

22. The downhole well-drilling seal assembly of claim 17, further comprising:

a bearing member positioned at a hub of the at least one flexible annular sub-element to reduce friction between the at least one flexible annular sub-element and the substantially rigid annular member when the at least one flexible annular sub-element rotates about the annular axis of the substantially rigid annular member.

* * * * *